United States Patent [19]

Brecher

[11] Patent Number: 4,780,936

[45] Date of Patent: Nov. 1, 1988

[54] STAY-TIED SHOE LACES

[76] Inventor: Karen J. Brecher, 99 Creston Ave., Tenafly, N.J. 07670

[21] Appl. No.: 24,317

[22] Filed: Mar. 10, 1987

[51] Int. Cl.[4] ..... F16G 11/00

[52] U.S. Cl. ..... 24/119; 24/306; 24/117

[58] Field of Search ..... 24/119, 117 R, 121, 24/128, 117 A, DIG. 11, 306; 36/50

[56] References Cited

U.S. PATENT DOCUMENTS

| | | | |
|---|---|---|---|
| 528,464 | 10/1894 | Craig | 24/119 |
| 647,824 | 4/1900 | Girtanner | 24/119 |
| 2,175,962 | 10/1939 | Kenifick | 24/128 R |
| 2,324,962 | 7/1943 | Storey | 24/121 |
| 2,650,399 | 9/1953 | Torelli | 24/117 R |
| 4,291,439 | 9/1981 | Riti | 24/119 |
| 4,428,101 | 1/1984 | Harkavy | 24/117 R |
| 4,545,138 | 10/1985 | Blum | 24/119 |
| 4,553,293 | 11/1985 | Blum | 24/119 |
| 4,571,854 | 2/1986 | Edens | 24/119 |

*Primary Examiner*—Victor N. Sakran
*Attorney, Agent, or Firm*—Kuhn and Muller

[57] ABSTRACT

Footwear such as shoes, sneakers and the like are provided with a pair of flexible band members, one end of each flexible band member being secured to a tongue of the footwear in the vicinity of a knot tying together ends of laces for the footwear; the other, free ends of the band member being movable between an unfastened position and a releasably fastened position about a bow-knot formed in the tied together shoe laces to impede the loosening of the bow-knot.

14 Claims, 3 Drawing Sheets

2
12
37
10
15
11
16
26
14
42
40

20
37
22
11
16
24
36
10
12
18
28
26
32
30
34
15
39
38

STAY-TIED SHOE LACES

FIELD OF THE INVENTION

The present invention relates to an improved device for securing the bow-knots used to tie laces on footwear and to footwear including the same.

BACKGROUND OF THE INVENTION

Shoes, sneakers and other footwear which utilize a lace to securely fasten the footwear on the foot of the wearer often present the annoyance of bow-knots which loosen or become untied at inconvenient and sometimes hazardous times. Particularly with respect to sport activities, it can actually stop play altogether until the laces are properly tied to avoid the shoe being dislodged from the foot or the wearer from tripping over the laces by inadvertently stepping on the unfastened end.

With respect to children in their play activities, loosening of the bow-knot places a burden on parents and other adults around them because the task of retying the laces may be beyond the child's capability. It is also difficult to perform this task while wearing gloves or mittens or may be beyond the abilities of many physically handicapped persons.

Heretofore, a variety of devices have been suggested to prevent shoelaces from becoming untied, but they exhibited a number of problems which have detracted from their acceptance. These devices are often cumbersome and complicated to use. Furthermore, many such devices may not be configured to remain on the shoes when they are stored, or if attached to the shoe, they interfere with the comfort thereof or are simply so complicated to use that they are unacceptable.

More recently, devices have been disclosed, for example, in U.S. Pat. Nos. 4,291,439, 4,428,101, 4,553,293 and 4,571,854 which include strips of interlocking materials (including hook and loop elements) for securing the bow-knots of tied laces or engage the laces to provide a knotless fastening. These devices are not secured to the footwear and require manipulation, both for installing on the laces or shoes and for the operation thereof, which may be unacceptable for children or the handicapped. In addition, they may generally not be stored with the shoe since they would interfere with tying of the laces when the shoe is first being placed on the wearers foot or with loosening of the laces for removal of the shoe.

In U.S. Pat. No. 4,545,138, a device is disclosed which is secured to the tongue of the shoe and consists of elastic means for engaging opposed sides of the bow-knot to impede the knot from becoming untied while simultaneously exposing the bow-knot and maintaining the normal appearance thereof. The device, however, requires manipulation by the user to tension the engaging means so as to impede the knot from becoming untied, which may be beyond the ability of a handicapped person or a child.

Thus, there is a need for a device which can be used even by children and persons having physical impediments, to impede the untying of a bow-knot formed to fasten laces on shoes; and particularly, for such a device which is secured to the footwear and can be stored therewith without interfering with the putting-on or taking-off of the shoe.

SUMMARY OF THE INVENTION

In accordance with the present invention, a stay-tied device is provided which is secured to a piece of footwear and can readily be used by the wearer to impede the loosening of a bow-knot formed to tie the laces of the footwear.

According to one embodiment of the invention, the "stay-tied" device includes first and second flexible band members having first and second faces and first and second ends, each of which flexible band member is secured at the first end thereof to the face of the tongue of footwear such as shoes, sneakers and the like in the vicinity of a knot tying together ends of the shoelace. The second ends of each of the flexible band members extend freely in opposing directions, being movable between a fastened and unfastened position.

The first flexible band member includes the first portion of an engaging means which is fixed to a region of the first face thereof extending from the second end and the second flexible based member includes a second complementary portion of the engaging means which is fixed to a region of the second face thereof extending from the second end for releasable engagement with the first portion of the engaging means. The second ends of each of the flexible band members are adapted to be movable about a bowed shoe lace from opposite side causing the complementary portions of said engaging means to be interengaged with the two flexible band members being in a fastened position about the bowed knot.

The device, which is integral with the footwear, is readily manipulatable to provide a means for impeding the bow-knot from being untied and it does not interfere with the wearer putting-on or taking-off the footwear. The releasable engagement means for fastening the opposing movable ends of the flexible band members includes, for example, complementary hook and loop elements such as that sold under the trademark VELCRO. The hook elements are included on one of the faces of one flexible member at its free end, and the loop elements are included on the face of another of the flexible members at its free end. The opposing free ends of the flexible members are then readily pressed together about the bow-knot formed in the tied shoe lace, causing the hook and loop elements to mate and become engaged.

According to another embodiment of the present invention, the "stay-tied" device includes a first flexible band member having hook members over substantially the outward facing face thereof. One end of the band member is secured to the tongue of footwear in the vicinity of the knotted shoe laces and the second end is free. The hook members then provide means for engaging with the shoe lace as it is being tied into a knot to assist in inhibiting the loosening of the knot until the bow-knot is completely formed. The second flexible band member of the "stay-tied" device is secured at its first end to the tongue of the footwear and has a complementary loop engaging means fixed to a second face thereof extending from its free second end, which second end is adapted to be movable about the bow-knot of tied shoe laces to be interengaged with the free second end of the first flexible band member into a fastened position therewith about the bow-knot.

Other advantages of the invention will become apparent from the following detailed description taken in conjunction with the accompanying drawing.

DESCRIPTION OF THE PREFERRED EMBODIMENTS

Figure 1:
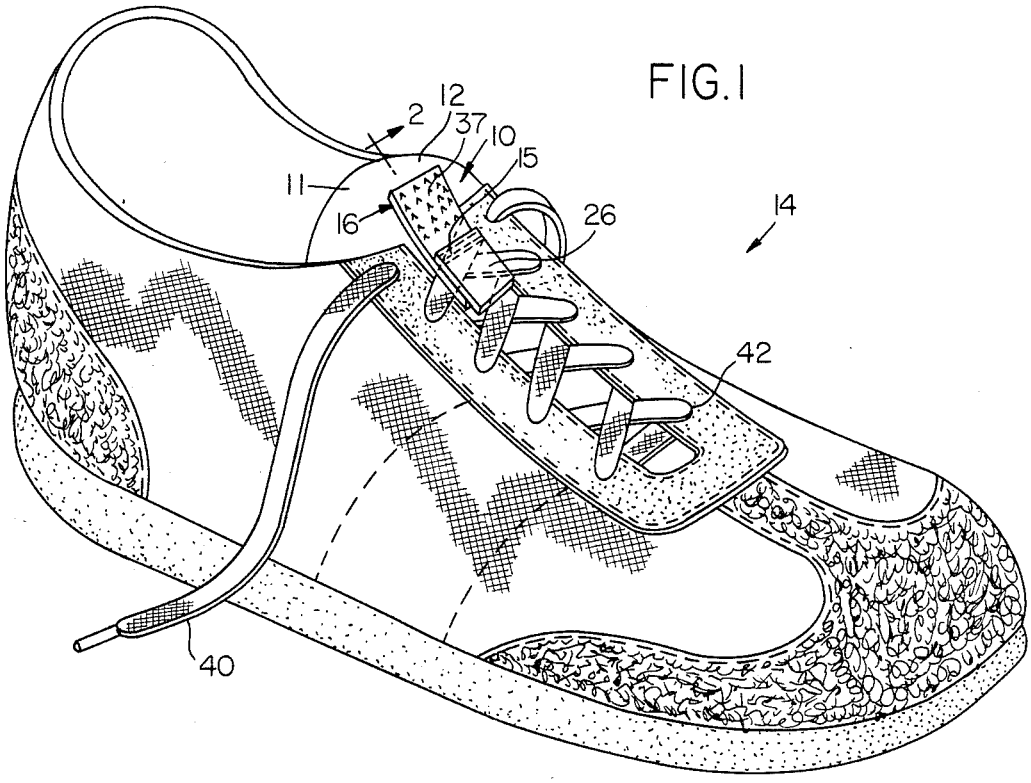
FIG. 1 is a perspective view of a preferred embodiment of a shoe with a "stay-tied" device of the invention.
Figure 2:
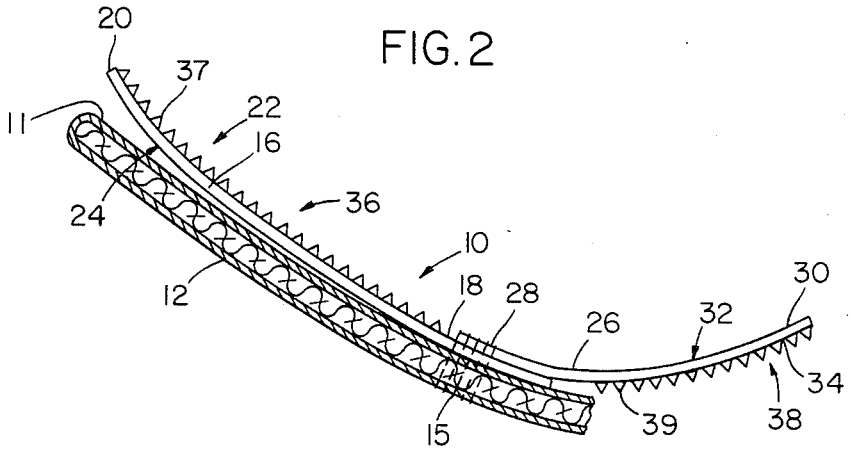
FIG. 2 is a partial cross-section view taken along lines 2—2 of FIG. 1.
Figure 4:
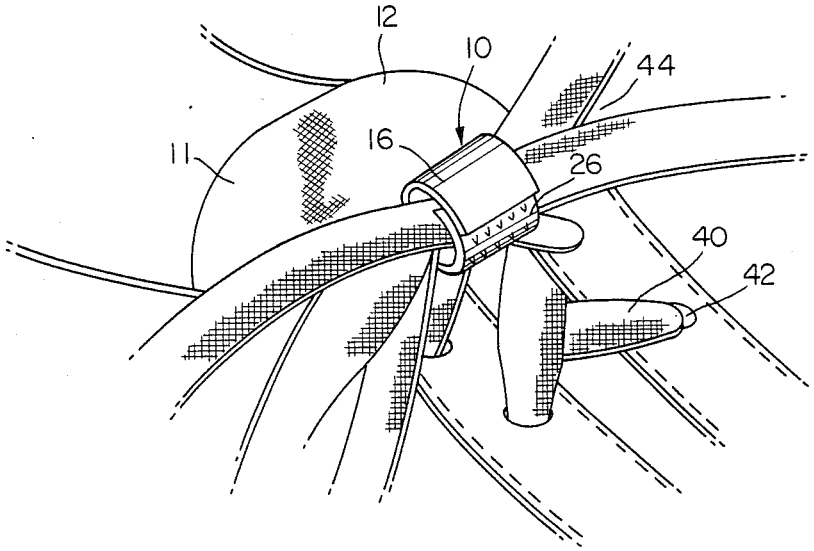
FIG. 4 is an enlarged front view of a shoe showing the "stay-tied" device in a position secured about a bow-knot formed by tied shoe laces.
Figure 3:
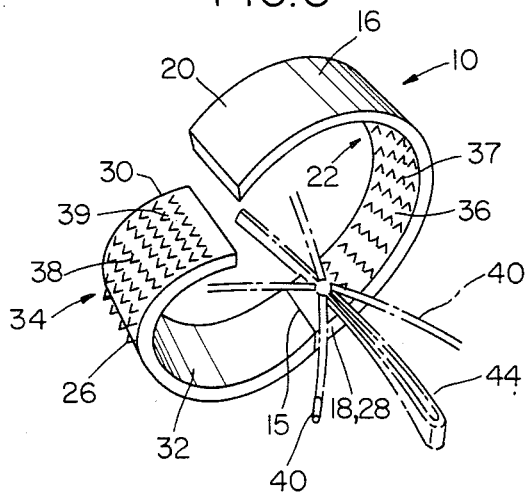
FIG. 3 is an enlarged perspective view of the "stay-tied" device of FIG. 2 as it is moved into an engaging position.

Referring now to the drawings where like reference numerals denote like parts, there is shown in FIGS. 1, 2, 3 and 4, a "stay-tied" device 10 which is secured to the tongue 12 of shoe 14. A shoe lace 40 is threaded through a plurality of eyelets 42 included on the shoe 14 as would normally be the case.

The "stay-tied" device 10 includes a first flexible band member 16 having first and second ends 18, 20, respectively, and first and second faces 22, 24, respectively; and a second flexible band member 26 having first and second ends 28, 30 respectively, and first and second faces 32, 34, respectively. The first ends 18, 28 of the first 16 and second 26 band members are secured at the top surface 11 of the shoe tongue 12 by stitching 15 or the like; and the second ends 20, 30 of the band members 16, 26 are free and movable. The first face 22 of band member 16 has regions 36 of hook elements and the second face 34 of band member 26 has regions 38 of loop elements. The regions 36 of hook elements comprises a field of hook elements 37 over the first face 22 of band member 16, extending from the second end 20 thereof substantially to the first, secured end 18; and the regions 38 of loop elements comprises a field of loop elements 39 over the second face 34 of band member 26, extending from the free end 30 thereof substantially to the first, secured end 28. The first ends 18 and 28 of band members 16 and 26 are secured 15 to the tongue 12 generally in the vicinity of where the bow-knot of the tied shoe lace 40 would be formed with the free, second ends 20, 30 of the band members 16, 26, extending beyond the vicinity of the tied bow-knot in opposite directions.

Flexible band materials especially suitable for use in the "stay-tied" device of this invention is commercially available in the form of tapes sold under the trade name of VELCRO woven nylon hook and loop fasteners. The hook tape is a woven nylon tape provided with aligned, minute flexible hooks secured to the woven substrate by an elastomeric binder coat. The loop tape is similar to the hook tape except that, instead of hooks, a mat composed of hundreds of small, soft loops is bonded to the woven substrate. The ends of flexible tape may be joined to the tongue by stitching, stapling, heat bonding or the like. As would be evident, the first ends of the separate flexible strips to be used in the "stay-tied" device of the invention may be secured together before being secured to the tongue of a shoe with the first face of the first flexible band member and the second face of the second flexible band member being in opposed relationship. The opposing first and second faces of the two flexible band members may overlap for a short distance at the first ends which are secured together.

In operation, the ends of shoe lace 40 are tied in a bow-knot 44 (FIGS. 3 and 4) as they normally would be with the user insuring that the knot as tied falls generally over the secured first ends 18, 28 of band members 16, 26, and with the free second ends 20, 30 extending in opposite directions beyond the bow-knot 44. Once the bow-knot is tied, the free second ends of band members 16, 26 are closely drawn about the bow-knot 44 and overlapped, the fields of complementary hook 37 and loop 39 elements thus being brought into interengagement. The first and second flexible band members are thus fastened and closely drawn about the tied bow-knot 44 to impede the knot from becoming untied. Generally, the field 36 of hook elements 37 over the first face 22 of band member 26, when held in contact with the surface of the natural loop of the shoe lace in the tied bow-knot by interengagement of the complementary hook and loop elements, further assist in impeding the knot from being untied.

As would be evident, the separable fastener of the hook and loop type may be suitably formed by fields of complementary hook elements and loop elements extending over only a portion of the surfaces of the flexible band members to the extent required to prevent the parts from becoming disengaged until they are peeled apart by the user. Moreover, the length of each of the first and second flexible band members can be varied; they can both be the same length, or of different lengths, to the extent required to provide sufficient overlap of the second ends thereof to fasten the band members about the tied bow-knot and impede its being untied and to prevent the parts of the engaging means from becoming disengaged until they are disengaged by the user.

Figure 5:
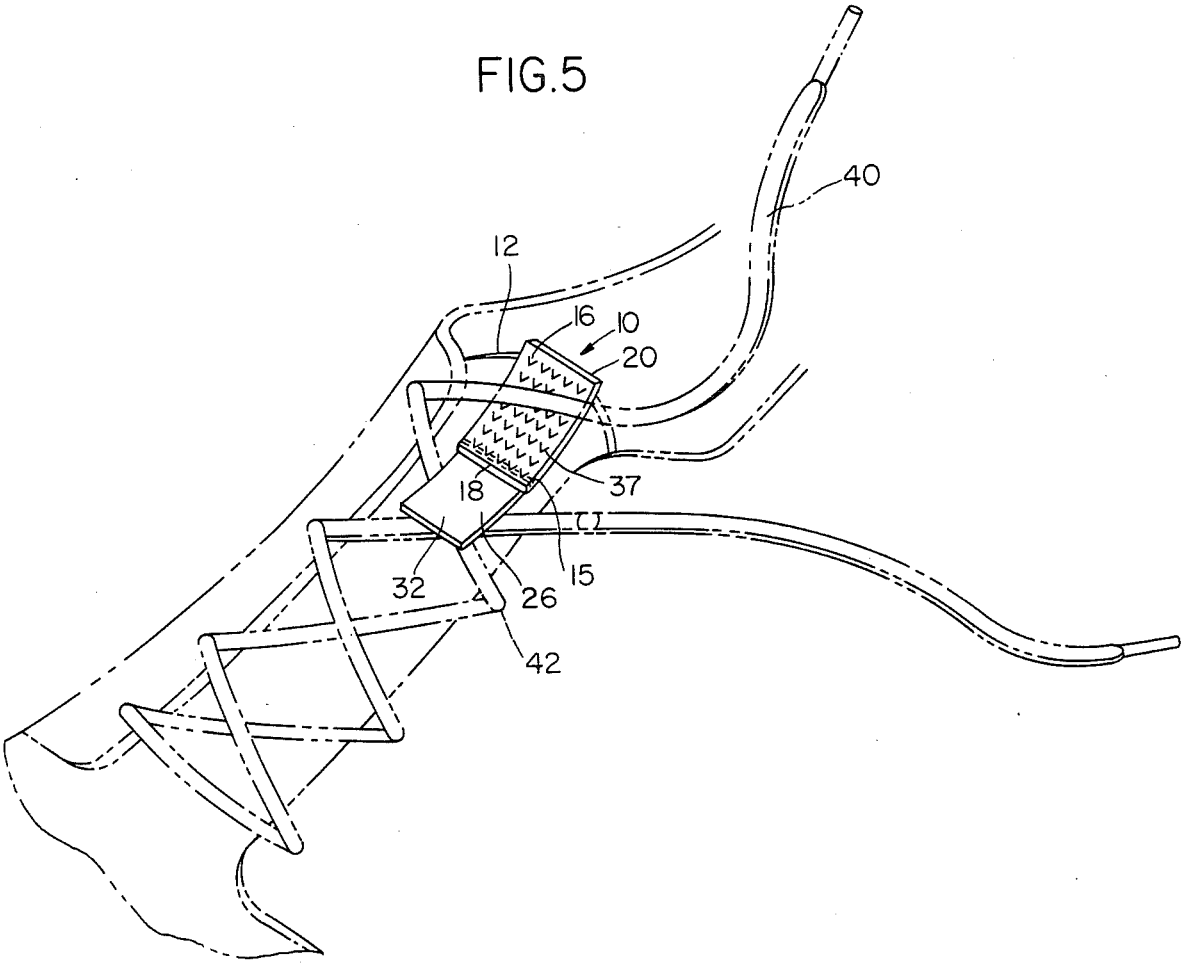
FIG. 5 is a perspective view of another embodiment of a stay-tied device of the invention.

Another embodiment is shown in FIG. 5 where it can be seen that the first end of the first flexible member 16 is secured to the surface of tongue 12 in the vicinity of the tied bow-knot, with the field of hook elements 37 disposed over the entire length of the outwardly facing first face 22 thereof. The first end 28 of second flexible band member 26 is also secured to the tongue as shown. Thus, in operation of this embodiment, when the ends of shoe lace 40 are first knotted as they normally would be, the laces in the knot are restrained from loosening by interengagement with hook elements 37 until the laces are tied in a bow-knot. Once the bow-knot is tied, the free ends 20 and 30 of band members 16 and 26 are drawn about the bow-knot and overlapped to engage the complementary engaging means with the first and second band members being in a fastened position.

As will be apparent to those skilled in the art, the "stay-tied" device may be used as part of any article in which bow-knots are used to secure laces or strings. It will also be apparent to those skilled in the art, any suitable releasable engaging or locking means may be used in place of the hook and loop elements 37 and 39.

The principles, preferred embodiments and modes of operation of the present invention have been described in the foregoing specification. The invention is not to be construed as limited to the particular forms disclosed, since these are regarded as illustrative rather than restrictive and variations and changes may be made by those skilled in the art without departing from the spirit of the invention.

What is claimed is:

1. Footwear with a tongue and laces comprising:
(a) a shoe tongue having a front face and a rear face;
(b) a first flexible band member having first and second ends and first and second faces;
(c) a second flexible band member having first and second ends and first and second faces;
(d) securing means for securing the first end of said first flexible band member and the first end of said second flexible band member to the front face of said tongue in the vicinity of a knot tying together ends of a shoe lace;
(e) said first flexible band member having a first portion of an engaging means which extends over a region of the first face of said first band member from the second end thereof, said first face of said band member outwardly facing, from the front face of the shoe tongue and said second flexible band member having a second complementary portion of said engaging means for releasable engagement with said first portion which extends from the second end of the band member over a region of the second face thereof, which second face is facing the front face of the shoe tongue;
(f) said first and second band members being movable between an unfastened position and a fastened position;
(g) said first and second band members being adapted to extend about and cover a tied bow-knot of said laces to permit interengagement of said first and second portions of said engaging means in a fastened position.

2. The footwear according to claim 1, wherein said second ends of said first and second flexible band members extend in opposite directions from each other.

3. The footwear according to claim 1, wherein said engaging means is a separable fastener of a hook and loop type.

4. The footwear according to claim 1, wherein the first ends of said first and second band members are secured together in an overlapping relationship.

5. The footwear according to claim 1, wherein said first portion of engaging means comprises a field of hook type elements substantially over the first face thereof and said first end of the first band member is secured to the front face of said tongue with at least a portion of said field of hook type elements being disposed in a vicinity of a knot tying together ends of a shoe lace.

6. The footwear according to claim 5, wherein said hook type elements are adapted to engage the shoelaces first knotted and restrain the loosening thereof until the laces are tied into a bow-knot.

7. The footwear according to claim 5, wherein said hook type elements over the first surface of said first flexible band member are adapted to permit interengagement of said hook type elements with a portion of the laces in a tied bow-knot.

8. The footwear according to claim 1, wherein said first and second band members are adapted to extend about and cover substantially only the laces in a tied bow-knot.

9. Footwear with a tongue and laces comprising:
(a) a shoe tongue having a front face and a rear face;
(b) a first flexible band member having first and second ends and first and second faces, said first end being secured to the front face of said shoe tongue in the vicinity of a knot tying together ends of a shoe lace and said first face thereof which is outwardly facing from the front face of said tongue having the hook type elements of a separable hook and loop type engaging means on a region of said first face extending from the second end;
(c) a second flexible band member having first and second ends and first and second faces, said first end being secured to the front face of said shoe tongue in the vicinity of a knot tying together ends of a shoelace and said second face thereof which is facing the front face of the shoe tongue having the loop type elements of a separable hook and loop type engaging means on a region of said second face extending from the second end;
(d) the second ends of said first and second band members extending in opposite directions from each other and being movable between an unfastened position and a position with complementary portions of the separable hook and loop type engaging means being interengaged in a fastened position; and
(e) said first and second band members when in a fastened position being adapted to extend about and cover a tied bow-knot of ends of a shoelace to restrain the loosening of said tied bow-knot.

10. The footwear according to claim 9, wherein the hook-type elements are in engagement with a portion of the laces in said tied bow-knot.

11. The footwear according to claim 9, wherein said first and second band members extend about essentially only laces of said tied bow-knot.

12. The footwear according to claim 9, wherein said hook-type elements extend over substantially the first face of said first band member.

13. The footwear according to claim 9, wherein said first band member and said second band member are of lengths substantially only required to provide sufficient overlap of the second ends thereof to fasten the band members about the tied bow-knot and impede the bow-knot from being loosened and to prevent complementary parts of said separable hook and loop type engaging mean from becoming disengaged until disengaged by a shoe user.

14. The footwear according to claim 9, wherein the first end of a first flexible band member is secured to the first end of a second flexible band member with the first face of the first flexible band member and second face of the second flexible band member being in opposed relationship and being overlapped for a short distance at the secured first ends thereof.

* * * * *